US006553879B2

(12) United States Patent
Morand

(10) Patent No.: US 6,553,879 B2
(45) Date of Patent: Apr. 29, 2003

(54) PAPER TOWELING DISPENSING SYSTEM

(75) Inventor: Michel Morand, Montreal (CA)

(73) Assignee: Perrin Manufacturing Company, City of Industry, CA (US)

( * ) Notice: Subject to any disclaimer, the term of this patent is extended or adjusted under 35 U.S.C. 154(b) by 0 days.

(21) Appl. No.: 09/953,084

(22) Filed: Sep. 13, 2001

(65) Prior Publication Data

US 2002/0096028 A1 Jul. 25, 2002

Related U.S. Application Data

(60) Division of application No. 09/409,821, filed on Sep. 30, 1999, now Pat. No. 6,314,850, which is a continuation-in-part of application No. 09/164,440, filed on Sep. 30, 1998, now Pat. No. 5,979,822, and a continuation-in-part of application No. 09/012,103, filed on Jan. 22, 1998, now Pat. No. 6,224,010.

(51) Int. Cl.[7] ..... B26D 1/62; B26D 5/22; B26D 5/42; B26D 7/14

(52) U.S. Cl. ..... 83/37; 83/327; 83/322; 83/337; 83/422; 83/734; 83/443; 83/446; 83/450; 83/659; 225/2

(58) Field of Search ..... 83/13, 37, 648, 83/649, 650, 327, 334, 335, 336, 337, 422, 734, 443, 446, 447, 450, 322; 225/2, 96, 106, 16, 22, 34, 51, 67, 68, 69, 85, 90; 242/559, 559.1

(56) References Cited

U.S. PATENT DOCUMENTS

| | | | | |
|---|---|---|---|---|
| 1,543,299 | A | 6/1925 | Shelley | 83/334 |
| 2,051,242 | A | 8/1936 | Birr et al. | 225/96 |
| 2,560,061 | A | 7/1951 | Agamaite, Jr. | 83/322 |
| 3,575,328 | A | 4/1971 | Jespersen et al. | 225/2 |
| 3,739,965 | A | 6/1973 | Jespersen et al. | 225/96 |
| 3,896,691 | A | 7/1975 | Granger et al. | 83/335 |
| RE28,911 | E | 7/1976 | Jespersen et al. | 225/96 |
| 3,998,120 | A | 12/1976 | Granger et al. | 83/335 |
| 4,122,738 | A | 10/1978 | Granger | 83/314 |
| 4,186,633 | A | 2/1980 | Baumann et al. | 83/155 |
| 4,188,844 | A | 2/1980 | DeLuca | 83/337 |
| 4,213,363 | A | 7/1980 | Granger | 83/298 |
| 4,276,797 | A | 7/1981 | Baumann et al. | 83/308 |
| 4,307,639 | A | 12/1981 | DeLuca | 83/337 |
| 4,404,880 | A | 9/1983 | DeLuca | 83/42 |
| 4,432,261 | A | 2/1984 | DeLuca | 83/37 |
| 4,441,392 | A | 4/1984 | DeLuca | 83/337 |
| 4,621,755 | A | 11/1986 | Granger | 225/96 |
| 4,635,837 | A | 1/1987 | Granger | 225/96 |
| 4,712,461 | A | 12/1987 | Rasmussen | 83/334 |
| 4,807,824 | A | 2/1989 | Gains et al. | 242/560.1 |
| 4,844,361 | A | 7/1989 | Granger | 225/93 |
| 4,846,035 | A | 7/1989 | Granger | 83/337 |
| 5,013,291 | A | 5/1991 | Granger | 493/357 |
| 5,048,386 | A | 9/1991 | DeLuca et al. | 83/37 |
| 5,078,033 | A | 1/1992 | Formon | 83/335 |
| 5,108,357 | A | 4/1992 | Granger | 493/357 |
| 5,135,147 | A | 8/1992 | Granger | 225/96 |
| 5,146,830 | A | 9/1992 | Granger | 83/649 |

(List continued on next page.)

*Primary Examiner*—Charles Goodman
(74) *Attorney, Agent, or Firm*—Thomas R. Lampe

(57) ABSTRACT

Apparatus for dispensing paper toweling includes a rotatable toweling support roller and a cutter blade pivotally mounted on the outer peripheral portion of the roller. The blade is movable between a first position in which the cutting edge of the blade is positioned closely adjacent to the outer peripheral portion and a second position in which the blade is disposed at an angle relative to the outer peripheral portion with the cutting edge of the blade spaced from the toweling support roller. The cutter blade when in the second position projects in a direction generally opposed to the direction of rotation of the toweling support roller so that pulling force exerted on the toweling by a user will bear against the cutting edge of the cutter blade to sever the toweling.

2 Claims, 11 Drawing Sheets

FIG. 6

FIG. 9

U.S. PATENT DOCUMENTS

| | | | | |
|---|---|---|---|---|
| 5,147,279 | A | 9/1992 | Granger | 493/448 |
| 5,257,711 | A | 11/1993 | Wirtz-Odenthal | 225/14 |
| 5,441,189 | A | 8/1995 | Formon et al. | 225/2 |
| 5,924,617 | A | 7/1999 | LaCount et al. | 225/16 |
| 5,979,284 | A | 11/1999 | Granger | 83/649 |
| 5,979,822 | A | 11/1999 | Morand et al. | 242/564.2 |
| 6,079,305 | A | 6/2000 | Bloch et al. | 83/335 |
| 6,314,850 | B1 * | 11/2001 | Morand | 83/327 |
| 6,363,825 | B1 * | 4/2002 | Hagleitner | 83/337 |

* cited by examiner

PAPER TOWELING DISPENSING SYSTEM

This application is a division of U.S. patent application Ser. No. 09/409,821, filed Sep. 30, 1999, now U.S. Pat. No. 6,314,850. This application is a continuation-in-part of both U.S. patent application Ser. No. 09/164,440, filed Sep. 30, 1998, now U.S. Pat. No. 5,979,822 and U.S. patent application Ser. No. 09/012,103, filed Jan. 22, 1998, now U.S. Pat. No. 6,224,010.

TECHNICAL FIELD

This invention relates to dispenser apparatus for dispensing paper toweling from a roll of paper toweling. The invention also encompasses a method of dispensing paper toweling from a roll of paper toweling.

BACKGROUND OF THE INVENTION

Many dispenser systems are known in the prior art for dispensing paper toweling from rolls thereof. In some cases the paper toweling is comprised of individual paper towel segments separated by perforated tear lines, and in others the toweling has no perforated tear lines formed therein, the user severing or cutting individual sheets from the toweling by some suitable means incorporated in the dispenser.

The dispenser system disclosed and claimed herein is of the latter type.

U.S. Pat. No. 4,404,880, issued Sep. 20, 1983, discloses a mechanism for cutting a web of flexible sheet material, such as paper toweling, which is adapted to be used in a dispenser having a feed roller and a pinch roller, between which rollers the web passes. A knife is pivotally mounted in the feed roller to swing about an axis laterally displaced from the plane of a radially outward portion of the knife defining a cutting edge which edge is projected outwardly beyond the periphery of the feed roller to cut the web as it passes over the feed roller. Cam followers are carried by the ends of the knife extending beyond the ends of the feed roller with the followers displaced from the pivot mounting axis of the knife. Stationary cams are mounted adjacent the ends of the feed roller which the cam followers on the knife engage to positively project the knife cutting edge beyond the feed roller periphery and retract the cutting edge upon rotation of the feed roller.

U.S. Pat. No. 5,048,386, issued Sep. 17, 1991, discloses a feed mechanism for feeding a web of rolled flexible sheet material, such as soft paper towels, out of a dispenser. The mechanism includes a feed roller within the dispenser and a web cutting blade in the feed roller and projectable and retractable therewith as the feed roller rotates. A contoured cam is attached to an end of the feed roller, and a spring-loaded cam follower presses against the contoured cam. The cam follower, through the cam, controllably assists in the rotation of the feed roller during the feed roller cycle when the blade cuts the web and thereafter to feed a free end of the material to an accessible position outside of the dispenser. The needed maximum pull forces by the user on the material to cut and withdraw the material from the dispenser are thereby significantly minimized, and the likelihood of the soft towel material tearing off in the user's wet hands is reduced.

The patents discussed above in the preceding two paragraphs are but two of many patents directed to dispensers which employ cutter blades associated with a paper towel support roller to cut paper toweling supported thereby. Other known patents utilizing this feature are: U.S. Pat. No. 5,441,189, issued Aug. 15, 1995, U.S. Pat. No. 5,048,386, issued Sep. 17, 1991, U.S. Pat. No. 4,712,461, issued Dec. 15, 1987, U.S. Pat. No. 4,441,392, issued Apr. 10, 1984, U.S. Pat. No. 5,078,033, issued Jan. 7, 1992, U.S. Pat. No. 5,146,830, issued Sep. 15, 1992, U.S. Pat. No. 5,147,279, issued Sep. 15, 1992, U.S. Pat. No. 5,013,291, issued May 7, 1991, U.S. Pat. No. 5,135,147, issued Aug. 4, 1992, U.S. Pat. No. 4,844,361, issued Jul. 4, 1989, U.S. Pat. No. 4,846,035, issued Jul. 11, 1989, U.S. Pat. No. 5,257,711, issued Nov. 2, 1993, U.S. Pat. No. 5,108,357, issued Apr. 28, 1992, U.S. Pat. No. 4,635,837, issued Jan. 13, 1987, U.S. Pat. No. 4,621,755, issued Nov. 11, 1986, U.S. Pat. No. 4,432,261, issued Feb. 21, 1984, U.S. Pat. No. 4,122,738, issued Oct. 31, 1978, U.S. Pat. No. 4,188,844, issued Feb. 19, 1980, U.S. Pat. No. 4,213,363, issued Jul. 22, 1980, U.S. Pat. No. 4,307,639, issued Dec. 29, 1981, U.S. Pat. No. 1,543,299, issued Jun. 23, 1925, U.S. Pat. No. 2,560,061, issued Jul. 10, 1951, U.S. Pat. No. 2,051,242, issued Aug. 18, 1936, U.S. Pat. No. 3,575,328, issued Apr. 20, 1971, U.S. Pat. No. 3,739,965, issued Jun. 19, 1973, U.S. Pat. No. 4,186,633, issued Feb. 5, 1980, U.S. Pat. No. 4,276,797, issued Jul. 7, 1981, RE.28,911, reissued Jul. 20, 1976, U.S. Pat. No. 3,998,120, issued Dec. 21, 1976, U.S. Pat. No. 3,896,691, issued Jul. 29, 1975.

DISCLOSURE OF INVENTION

The paper toweling dispensing system disclosed herein is characterized by its simplicity, reliability of operation and ability to operate in a quiet manner as compared to prior art devices also employing movable cutter blades, as represented by disclosures of the patents identified above. A very light pulling force can be used to operate the apparatus disclosed and claimed herein. Furthermore, the approach utilized by the invention disclosed and claimed in this application allows use of a smaller toweling support drum than would normally be the case in prior art systems employing a movable cutter blade to sever manually pulled toweling. This allows smaller sheets to be dispensed during each dispensing cycle.

The paper towel dispenser apparatus of this system is for dispensing paper toweling from a roll of paper toweling responsive to pulling forces being applied to the paper toweling.

The apparatus includes a housing. A roll support is associated with the housing for rotatably supporting a roll of paper toweling.

A rotatable toweling support roller is within the housing spaced from the roll support for receiving toweling from the roll of paper toweling and supporting the toweling. The toweling support holder has a cylindrically-shaped outer peripheral portion and is rotatable in a predetermined direction of rotation when pulling forces are applied to toweling supported thereby.

The apparatus includes a cutter blade having a cutting edge. The cutter blade is pivotally mounted on a toweling support roller about a pivot located at the cylindrically-shaped outer peripheral portion. The cutter blade is pivotally movable between a first position wherein the blade lies substantially flat against the toweling support roller with the cutting edge thereof positioned closely adjacent to the cylindrically-shaped outer peripheral portion and a second position wherein the blade is disposed at an angle relative to the cylindrically-shaped outer peripheral portion with the cutting edge thereof spaced from the toweling support roller. The blade when in the second position projects from the pivot in a direction generally opposed to the direction of rotation of the toweling support roller.

The apparatus also includes blade actuator means for pivoting the blade between the first and second positions responsive to rotation of the toweling support roller due to a pulling force being applied to toweling on the toweling support roller and tensioning of the toweling. The cutting edge of the blade when the blade is in the second position engages toweling on the toweling support roller during rotation of the toweling support roller to sever the toweling due to the pulling force and tensioning of the towel.

The apparatus also includes towel transfer means for positioning the lead end of reserve toweling on the toweling support roller responsive to depletion of the roll of paper toweling.

The paper toweling dispensing system also includes a method. The method includes the step of positioning paper toweling extending from a roll of paper toweling and having a lead end on a rotatable toweling support roller.

The lead end of the toweling is pulled to tension the toweling and cause rotation of the toweling support roller.

While the toweling is under tension and during rotation of the toweling support roller, a blade connected to the toweling support roller is pivoted to bring a cutting edge of a blade into engagement with the underside of toweling on the toweling support roller and to a cutting position in which the blade is disposed at an angle relative to the outer peripheral surface of the toweling support roller with the cutting edge thereof spaced from the toweling support roller and the blade projecting in a direction generally opposed to the direction of rotation of the toweling support roller.

The toweling is maintained under tension by continuing to apply a pulling force thereto while the blade is in the cutting position and the cutting edge thereof engages the paper toweling to sever the toweling.

The blade is pivotally connected to the toweling support roller at the outer periphery thereof and the blade is moved to the cutting position from a non-cutting position wherein the blade lies substantially flat against the toweling support roller with the cutting edge thereof positioned closely adjacent to the outer periphery of the toweling support roller in response to rotation of the toweling support roller.

Other features, advantages, and objects of the present invention will become apparent with reference to the following description and accompanying drawings.

BEST MODE FOR CARRYING OUT THE INVENTION

Figure 1:
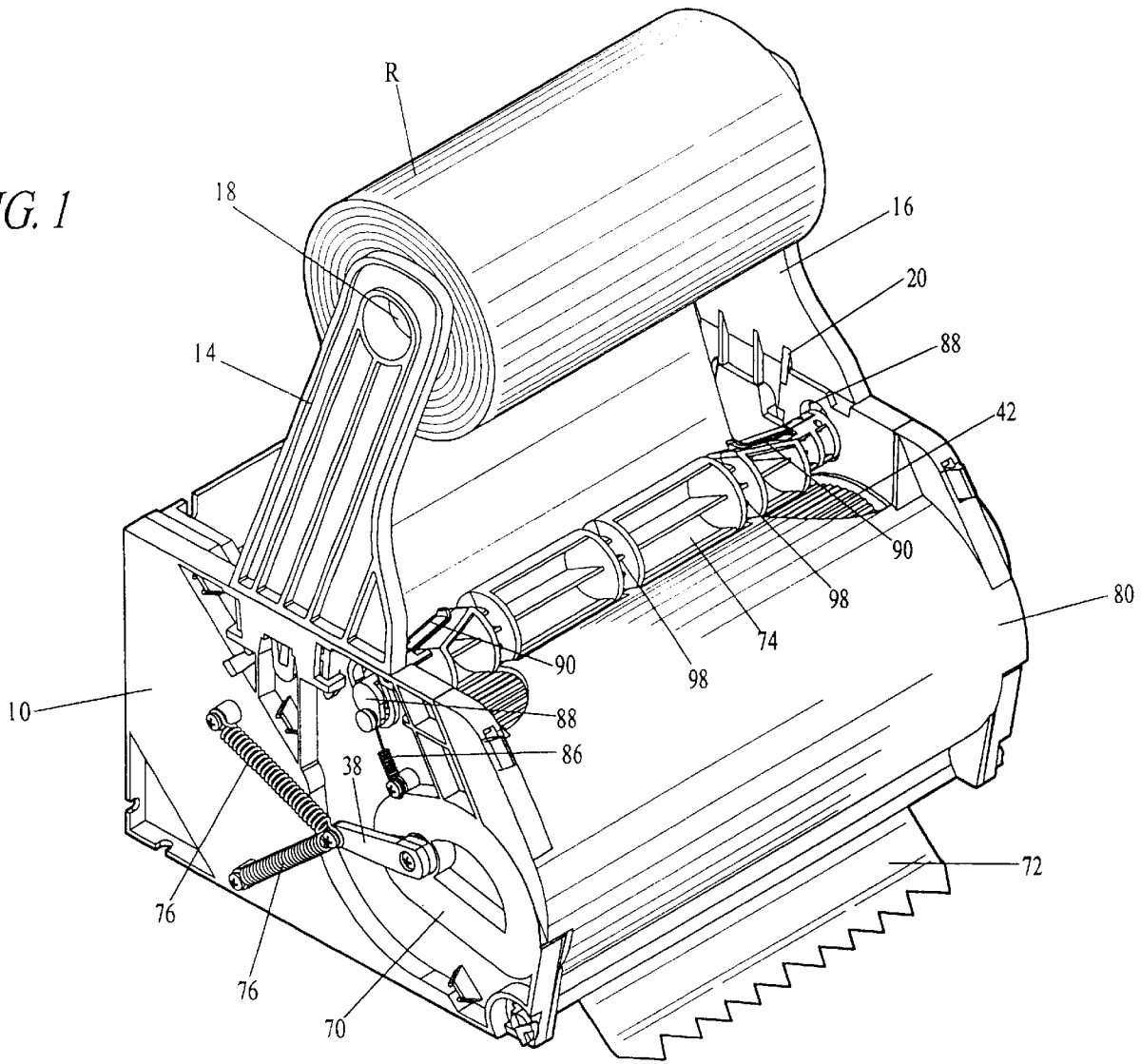
FIG. 1 is a frontal perspective view of paper towel dispenser apparatus constructed in accordance with the teachings of the present invention and a roll of paper toweling rotatably mounted thereon as viewed from the left.
Figure 2:
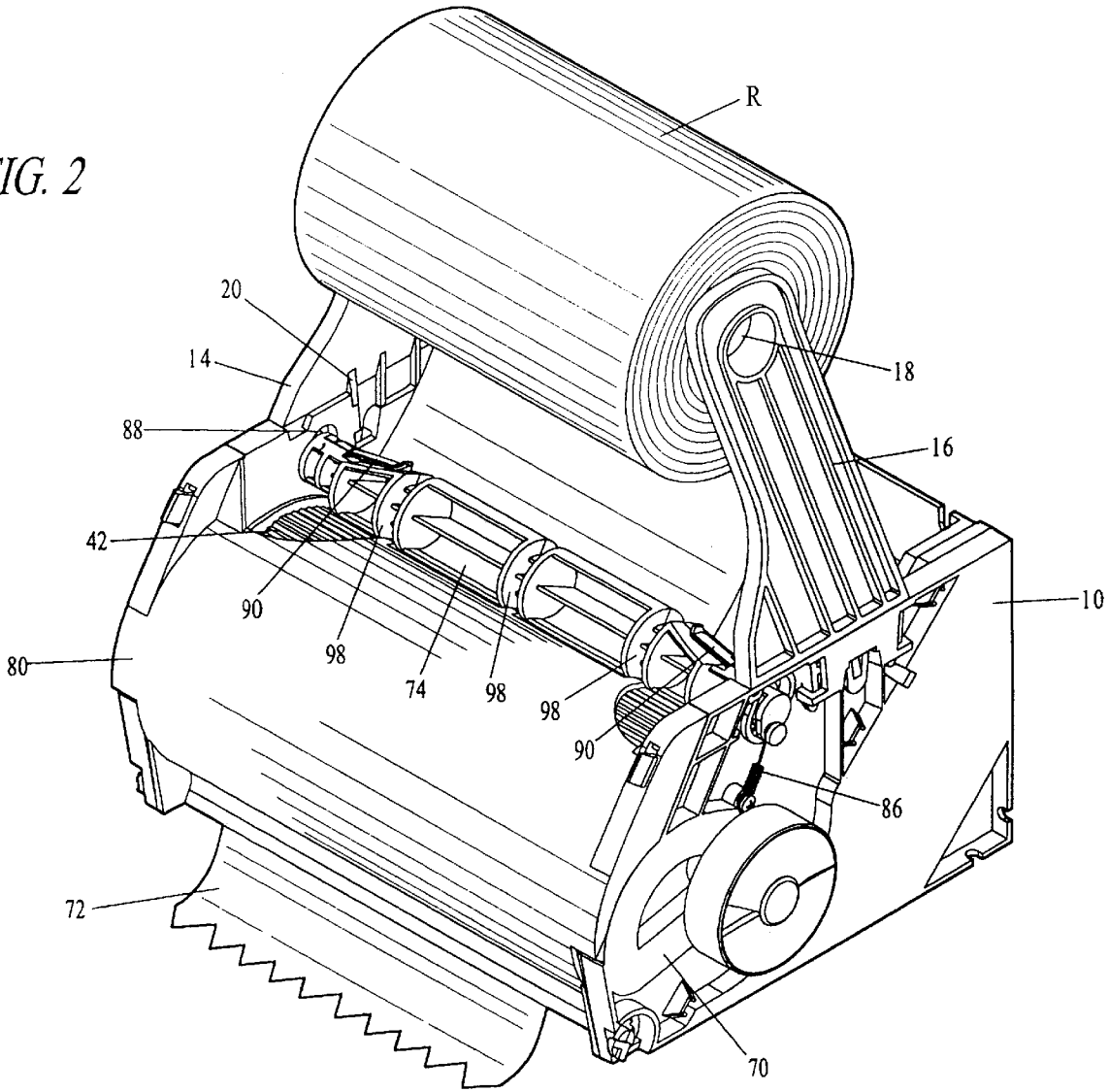
FIG. 2 is a frontal perspective view of the apparatus with roll of toweling as viewed from the right.
Figure 3:
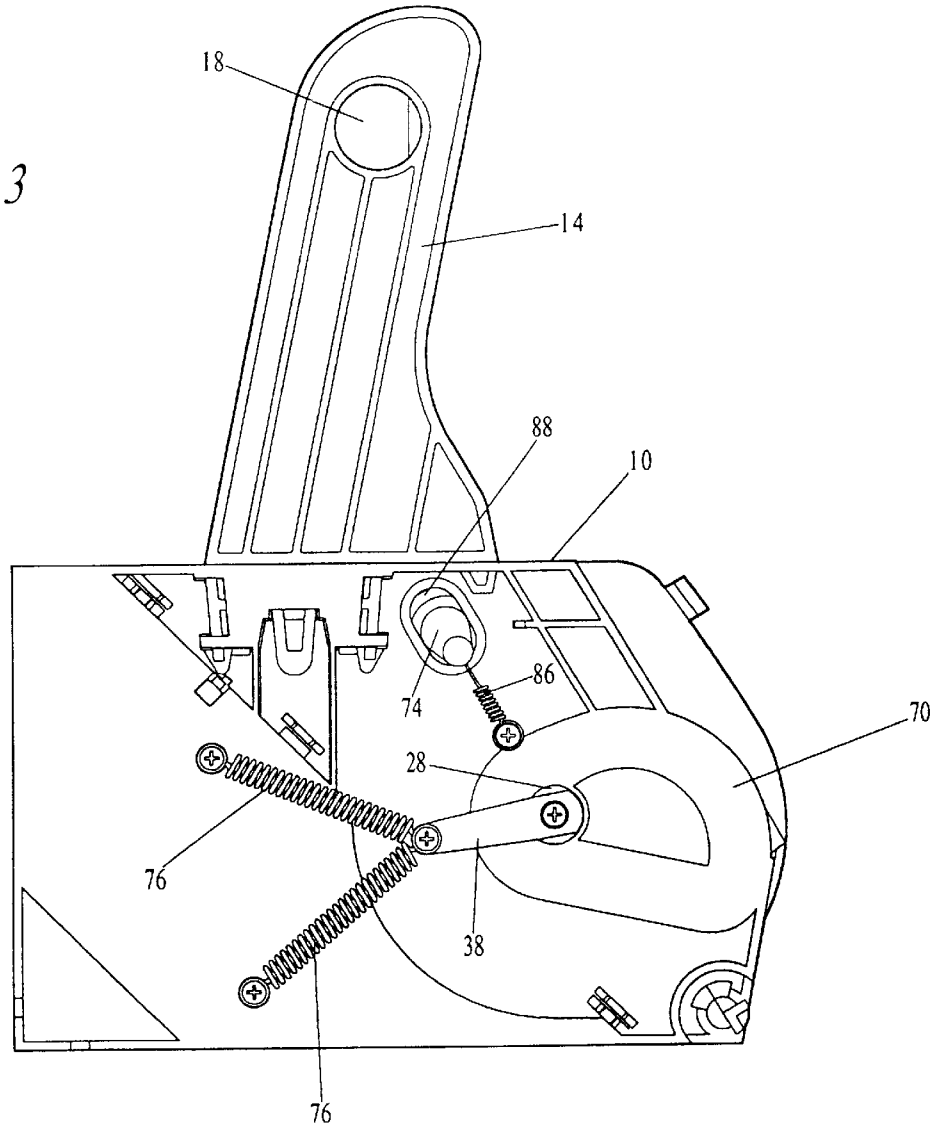
FIG. 3 is a side elevational view of the apparatus illustrating the left side thereof.

Referring now to the drawings, apparatus constructed in accordance with the teachings of the present invention includes a housing 10 which is suitably positioned in an outer paper towel dispenser cabinet (not shown) and secured thereto by any suitable expedient such as screws or other suitable mechanical fasteners. A roll support is operatively associated with the housing to rotatably support a roll of paper toweling 12. More particularly, the roll support includes two double-ended arms 14, 16 spaced from one another and roll engagement members 18 at the distal or upper ends of the arms for entering the ends of the roll 12. Roll 12 is directly rotatably supported by the roll engagement members.

Arms 14, 16 are pivotally connected to housing 10 by pivot connectors 20. The pivot connectors are located outwardly of the ends of the roll of paper toweling 12 and lower than roll engagement members 18 whereby the weight of the roll of paper toweling will exert forces on the arms continuously urging the ends of the arms with the roll engagement members toward one another and toward the roll of paper toweling. This results in frictional forces being applied to the roll of paper toweling resisting rotation of the roll of paper toweling to prevent overspin during dispensing. Furthermore, dislodgment of the roll from the roll engagement members is resisted.

A rotatable toweling support, roller 22 is within the housing and spaced from the roll support comprised of arms 14, 16 and roll engagement members 18. The toweling support roller is for receiving toweling from the roll of paper toweling 12 and supporting the toweling.

The toweling support roller 22 has a cylindrically-shaped outer peripheral portion and is rotatable in a predetermined direction of rotation when pulling forces are applied to toweling supported thereby.

Figure 5:
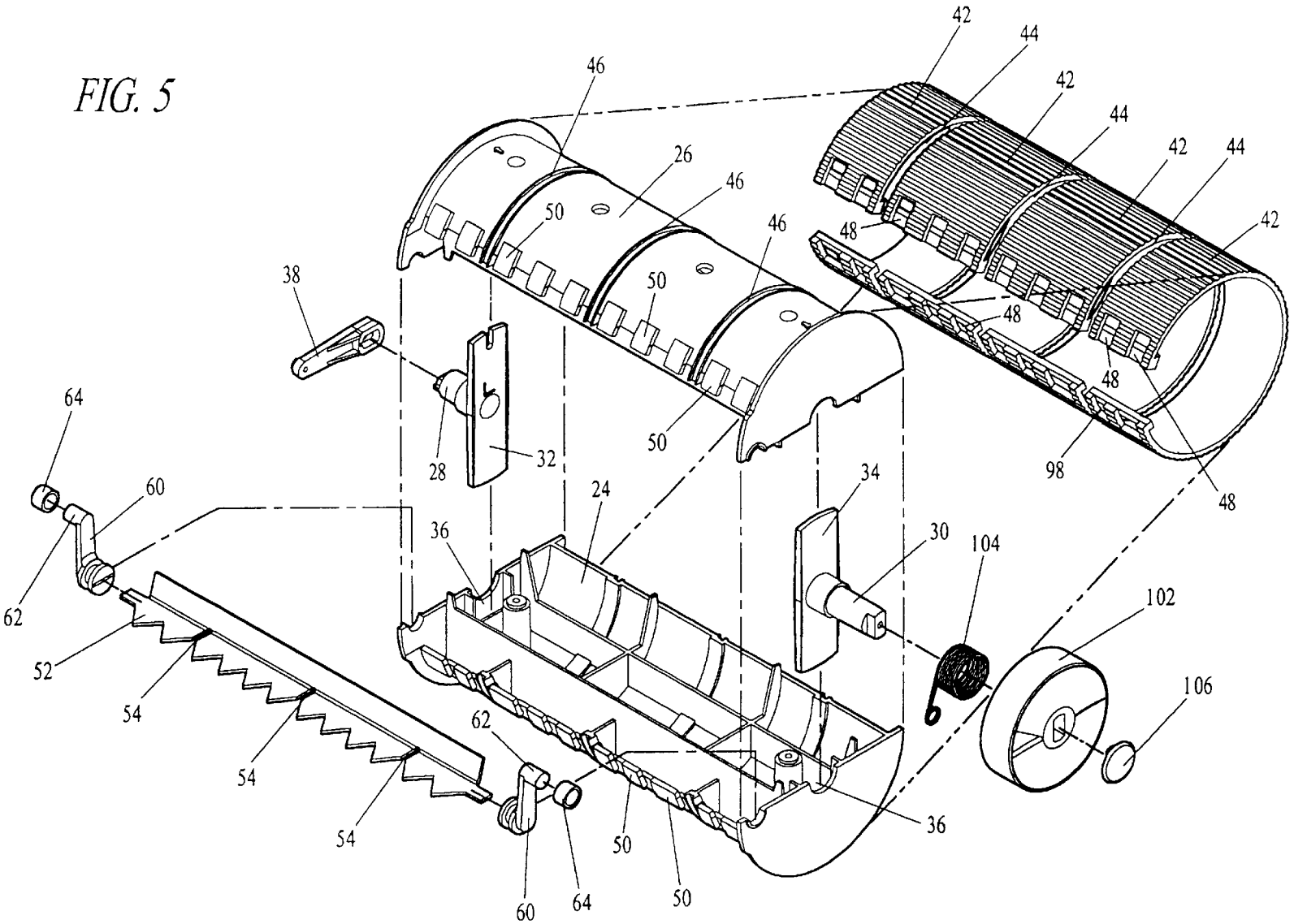
FIG. 5 is an exploded view illustrating selected structural elements of the apparatus.

As can be seen in FIG. 5, the roller 22 includes two roller halves 24, 26 which are assembled together. Stub shafts 28, 30 are attached to mounting plates 32, 34, respectively, the mounting plates inserted in recesses 36 located at the ends of the roller halves 24, 26 to lock the stub shafts in place. That is, the stub shafts will rotate with the rest of the toweling support roller structure. A projection or lever arm 38 is connected to the distal end of stub shaft 28.

The ends of toweling support roller 22 comprise circular end plates 40 (see FIG. 4A) which form central openings or apertures accommodating the stub shafts. The cylindrically-shaped outer portion of the toweling support roller includes strips of material 42, preferably of rough surfaced material such as rubber or plastic, wrapped about the assembled roller halves 24, 26. These strips of material define parallel, spaced channels 44. More particularly, the strips 42 are located adjacent double ribs 46 formed on roller halves 24, 26 to form the channels. The strips of material 42 do not extend all the way about the assembled roller halves. Any suitable means may be employed to secure the strips of material to the roller halves. In the arrangement illustrated, the strips define recesses 48 at the ends thereof which accommodate clip elements 50 on the roller halves.

Figures 4A, 4B:
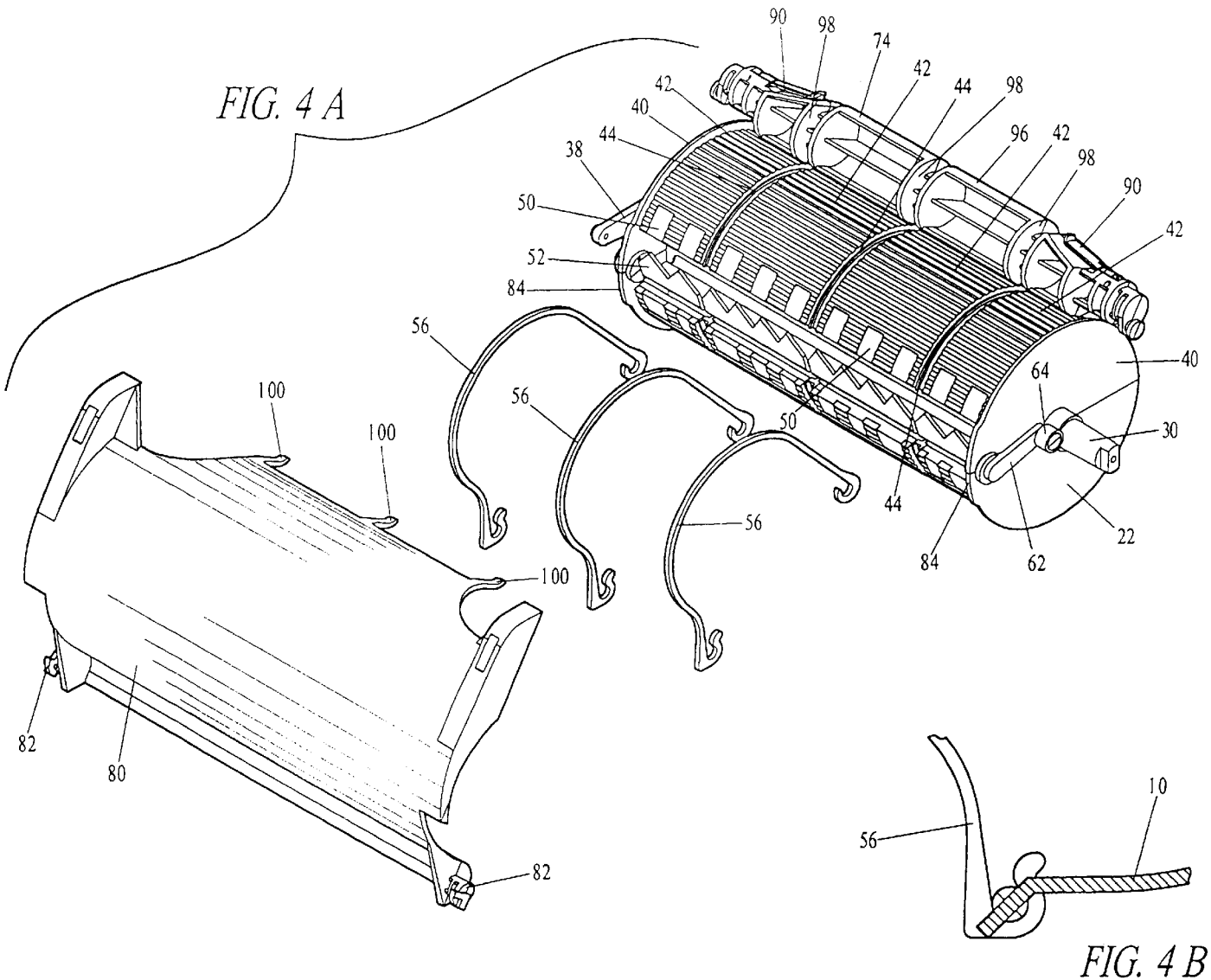
FIG. 4A is an exploded view illustrating selected components of the apparatus.
FIG. 4B is a greatly enlarged side view illustrating a portion of a stripper element of the apparatus connected to other apparatus structure.

With particular reference to FIG. 4A, the gap located between the free ends of strips of material 42 accommodates therein a pivotally mounted cutter blade 52 having a plurality of triangular-shaped teeth along an edge thereof. In addition, a plurality of recesses 54 extend inwardly from the teeth and between sets of teeth.

Channels 44 accommodate therein a plurality of stripper elements 56, the ends of the stripper elements having a hook-like configuration for attaching the stripper elements to the housing 10 (see FIG. 4B, for example). Thus, the stripper elements will remain stationary during rotation of the toweling support roller 22.

Cutter blade 52 is, as mentioned above, pivotally connected to the toweling support roller, in particular about a pivot located at the cylindrically-shaped outer peripheral portion thereof. Cutter blade 52 has attached to the ends thereof cam followers 60 each including a cam follower arm 62 and a roller 64. Each roller 64 is located externally of an end plate 40 and rides in a channel 66 of a cam 70. Cams 70 are located at both ends of the housing, it being understood that the channels 60 of these cams are directed inwardly.

Rotation of toweling support roller 22 will cause the cam followers to move along the cam surfaces defining channels 66. This, in turn, will cause the cutter blade to pivot relative to the toweling support roller 22.

The cutter blade moves between a first position wherein the blade lies substantially flat against the toweling support roller with the cutting or toothed edge thereof positioned closely adjacent to the cylindrically-shaped outer peripheral portion and a second position wherein the cutter blade is disposed at an angle relative to the cylindrically-shaped outer peripheral portion with the cutting edge thereof spaced from the toweling support roller. The cutter blade when in the second position projects from the pivot in a direction generally opposed to the direction of rotation of the toweling support roller.

Figure 6:
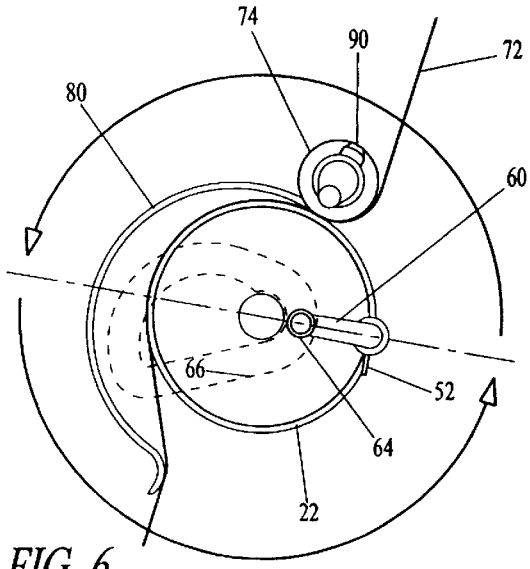
FIGS. 6–12 are schematic end views illustrating the cooperative relationships existing between the rotatable towel support roller, blade, cam follower and other structural components of the apparatus during sequential stages of operation of the apparatus.
Figure 7:
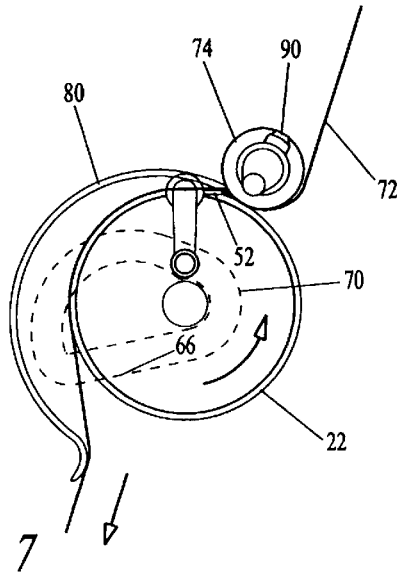

FIGS. 6 through 12 provide an illustration of the action of the cutter blade relative to the toweling support roller due to cam actuation. FIG. 6 illustrates by curved arrows the direction of rotation of the toweling support roller, cam follower and cutter blade. FIG. 6 shows the cutter blade in its first position, the position it assumes when the toweling support roller is at rest, i.e. its initial or rest position. Toweling 72 from roll 12 is located on and supported by the roller 22, the toweling passing under a member 74 forming a nip with the roller 22 which will be described in greater detail below. Suffice it to say at this point that the member 74 remains stationary until roll 12 is depleted and acts to apply pressure to the toweling support roller to keep the toweling paper under tension when the paper toweling is pulled during dispensing.

The toweling support roller 22 is maintained at its rest position as shown in FIG. 6 under the urging of two tension springs 76 which are attached to housing 10 at two spaced locations and converge at and are connected to projection 38 which rotates with the toweling support roller. It has been found that use of two tension springs 76 in the manner illustrated provides improved action insofar as positioning of the roller 22 is concerned. Springs 76 are loaded, i.e. the tension thereof increases, during the stage of operation indicated by the top-most curved arrow in FIG. 6 and they are unloaded to promote, rather than discourage, rotation of the roller in the area corresponding to the lowermost curved arrow in FIG. 6.

Figure 8:
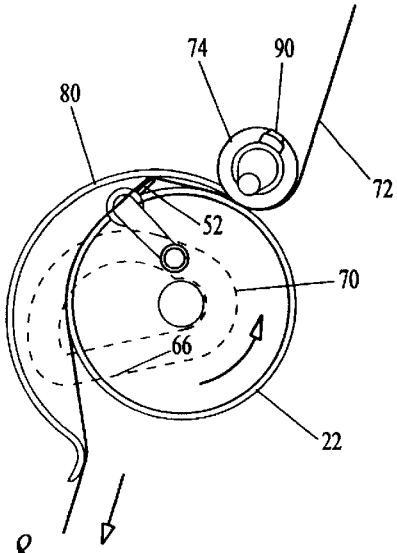
Figure 9:
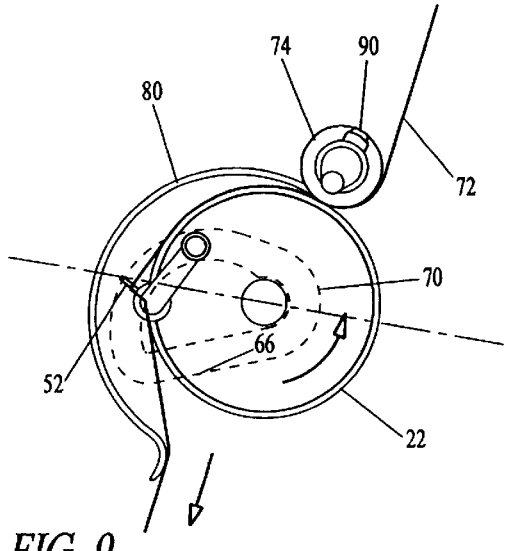
Figure 10:
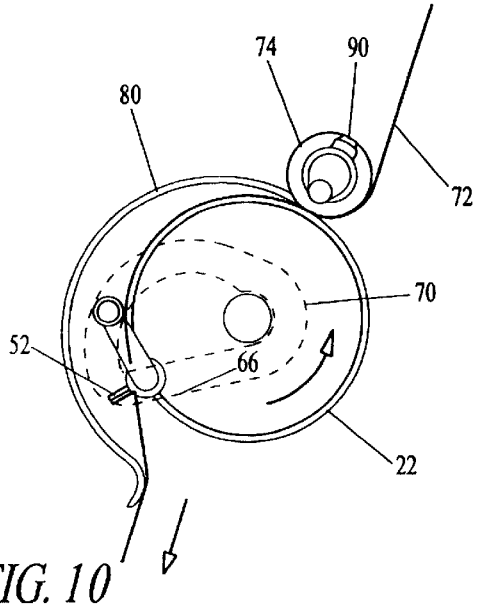
Figure 11:
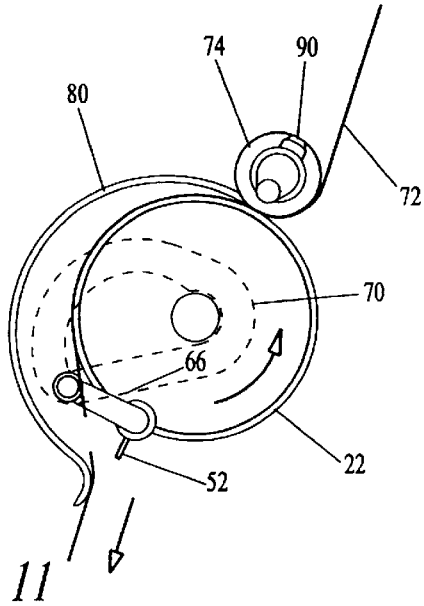
Figure 12:
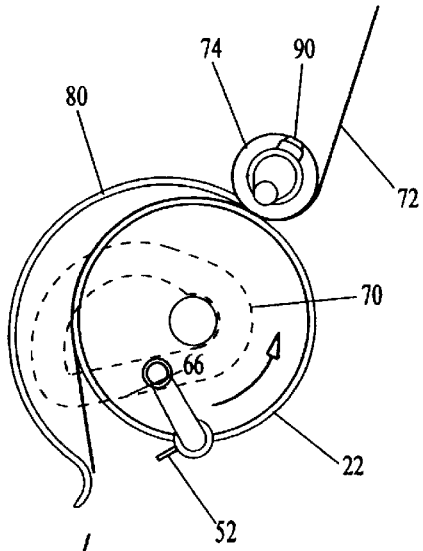

With reference to FIGS. 7 through 12, it can be seen that the cutter blade pivots while the roller 22 rotates due to tension or pulling forces being applied to the toweling 72. This pulling force results from a consumer grasping the free end of the toweling and pulling it in the direction of the straight arrow shown in FIGS. 7 through 11. The cutting or toothed edge of the blade 52 engages the underside of the toweling on roller 22 and pushes the toweling 72 upwardly as shown in FIG. 8. At this point the toweling is actually pulled against the edge of the blade and severing will occur during continued rotation of the roller as tension on the towel is maintained by the user, member 74 exerting force on the paper toweling and the toweling support roller to contribute to paper toweling tensioning. The blade, due to its unique positioning relative to the toweling support roller, serves not only to apply rotational forces to the roller but also the simultaneous act of severing. FIG. 10 shows the severing as having just taken place and FIGS. 11 and 12 show the severed toweling exiting the apparatus, it being understood that at this stage of the operation the springs 76 will return the roller to the initial rest position shown in FIG. 6.

The arrangement just disclosed provides for cutting with a very light pulling force being exerted on the toweling. The operation is extremely simple and very quiet, the consumer performing all the lightweight work involved to sever the toweling by pulling it against the blade during roller rotation. This is to be compared with known prior art devices wherein blade movement is often substantially perpendicular to the drum or roller surface (either toward or away from the drum), requiring a sharp blade to perform the severing function.

In the arrangement illustrated, a curved toweling guide plate 80 is employed to partially surround and cover the toweling support roll and provide guidance for the toweling. The guide plate 80 is pivotally connected to housing 10 by pivot pins 82 to allow the guide plate to be pivoted from its normal position wherein it partially surrounds and covers the toweling support roller to another position (not shown) wherein the guide plate does not partially surround or cover the toweling support roller and access to the support roller and its related structure can be had.

The arrangement disclosed provides a large dispensing angle; that is, the consumer can pull the toweling within a wide range defined only by the limitations provided by the guide plate and the toweling support roller.

The stripper elements engage the toweling during and subsequent to severing to ensure that the lead end of the toweling created after severing does not follow the roller 22.

To provide for an even quieter operation, protrusions 84 on end plates 40 of the toweling support roller engage the member 74 when the cutter blade 72 passes therebetween.

Member 74 is rotatably mounted on housing 10 extending between the side walls thereof. The ends of the member 74 pass through slots 88 formed in the side walls. The slots allow the rotatable member to be displaced relative to the housing. Protrusions 84 maintain the member 74 out of engagement with the blade and prevent it from falling into the gap between the ends of strips 42. Springs 86 extending between the housing and offset locations at the ends of member 74 continually bias the member 74 toward the toweling support roller 22.

Clips 90 are pivotally connected to the ends of the rotatable member 74 and are biased by springs 92 to clampingly engage planar surfaces 94 on member 74. Member 74 also has a smoothly rounded wall 96 located between the planar surfaces 94. Member 74 is configured to form peripherally extending grooves 98 which correspond to placement of the channels 44 and stripper elements 56. Fingers 100 on guide plate 80 extend into grooves 98.

Figure 13:
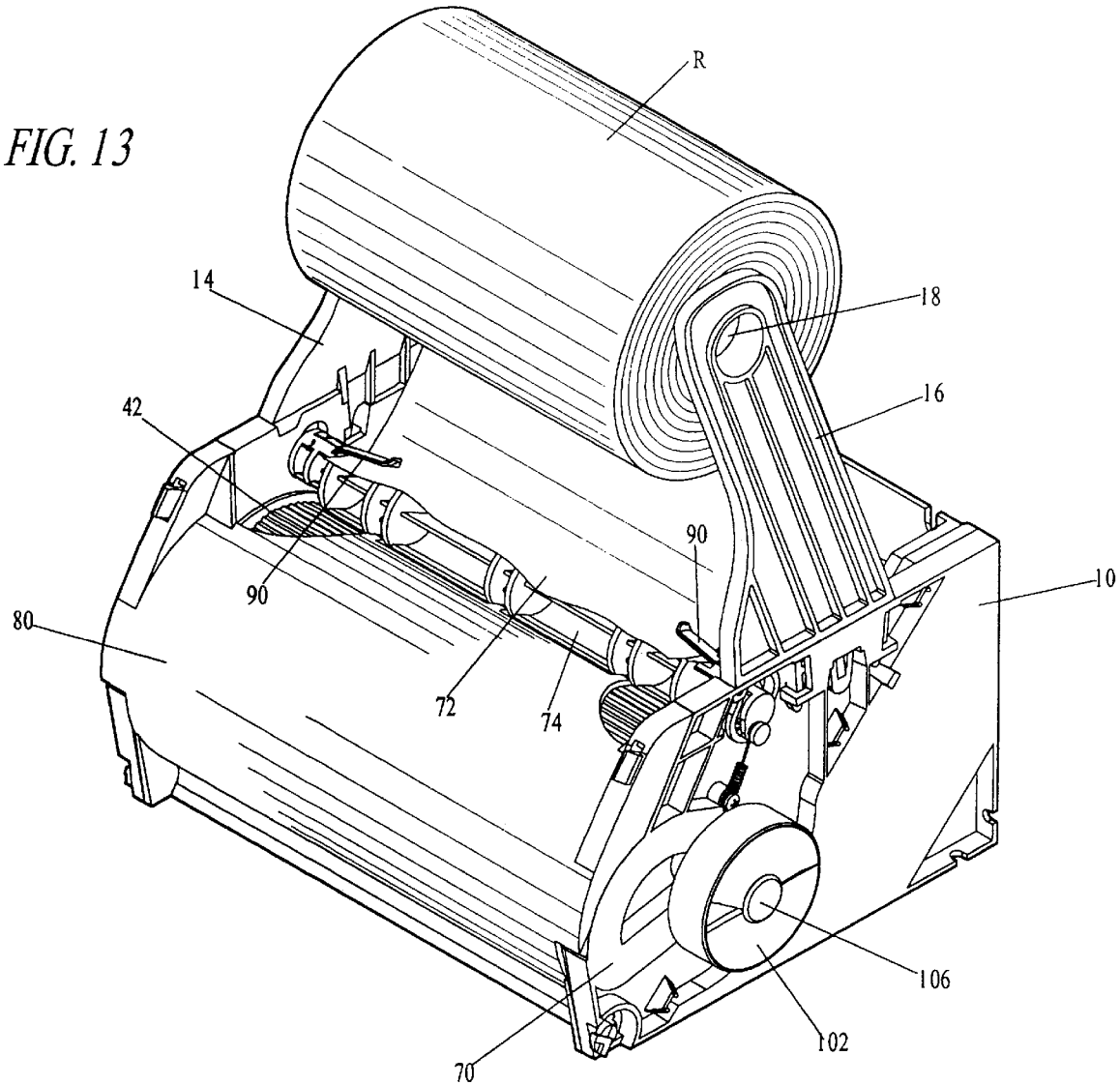
FIG. 13 is a view similar to FIG. 2 but illustrating the lead end of a reserve roll of toweling in position on a rotatable member incorporated in the apparatus used to effect transfer from a depleted roll of paper toweling to a reserve roll.

The rotatable member 74, in addition to acting as a paper toweling tensioner, is utilized to effect transfer from one roll of toweling upon depletion thereof to a reserve roll. FIGS. 13–21 provide an illustration of how this is accomplished. In FIG. 13 a reserve roll has been placed on roll engagement members 18, the primary roll having been removed by an attendant and placed in a suitable location within the confines of housing 10.

Figure 14:
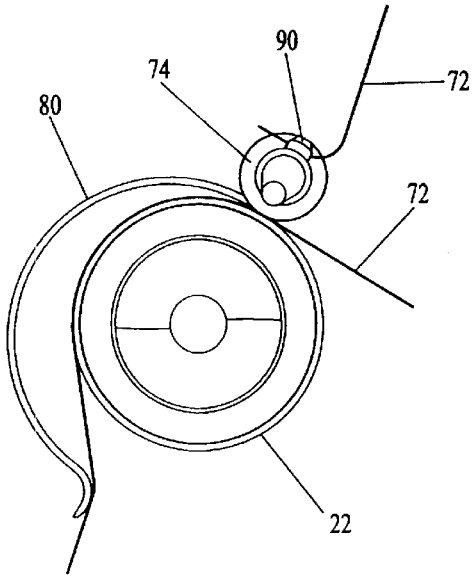
FIGS. 14–21 are schematic depictions of the toweling support roller and towel transfer mechanism employed therewith to effect transfer from a primary roll to a reserve roll, the structural elements being shown in the relative positions assumed thereby during sequential stages of operation of the apparatus.

The attendant then places the lead end of the toweling 72 from reserve roll R under clips 90 to clamp the lead end, as shown in FIG. 13, to the member 74. FIG. 14 shows the lead end of the reserve roll toweling clipped in position on the member 74. Also shown is the tail end of the primary roll toweling passing through the nip formed by toweling support roller 22 and member 74, the toweling from the primary roll being relatively freely movable along the smooth rounded wall 96 of the member 74. The member 74 is held against rotation by tension springs 86 described above.

Figure 15:
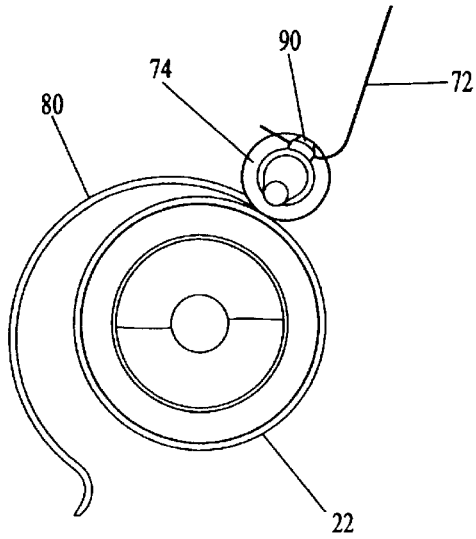
Figure 16:
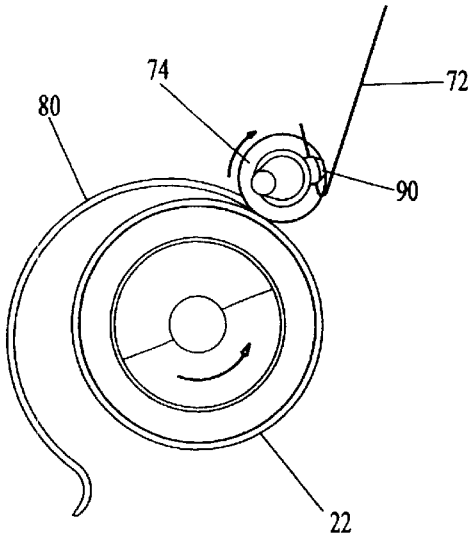

FIG. 15 illustrates the situation that exists when the toweling from the primary roll has exited the apparatus. In FIG. 16 the toweling support roller is rotated in the direction of the curved-arrow associated therewith in the figure. This is accomplished by manually rotating the knob of a one-way clutch 102. The knob is attached to a one-way clutch spring 104 (see FIG. 5) connected to stub shaft 30 of the toweling support roller. An end cap 106 provides a finished appearance.

Figure 17:
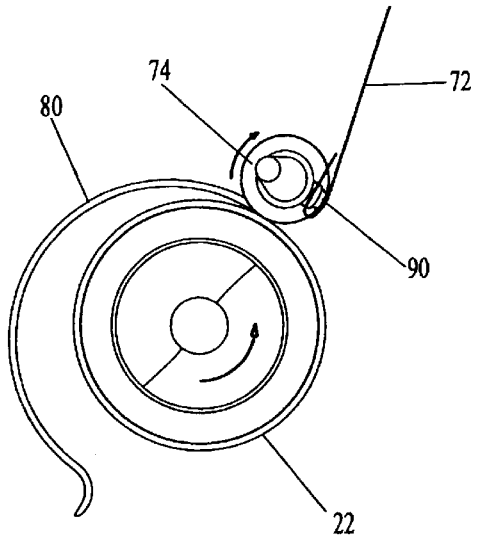

After the toweling from the primary roll has passed through the nip formed by toweling support roller 22 and member 74, these two structural elements will be in direct contact. More particularly, the member 74 will be in engagement with the roughened surfaces of strips of material 42. This will cause the member 74 to rotate against the urging of springs 86 as shown in FIG. 16 and FIG. 17.

Figure 18:
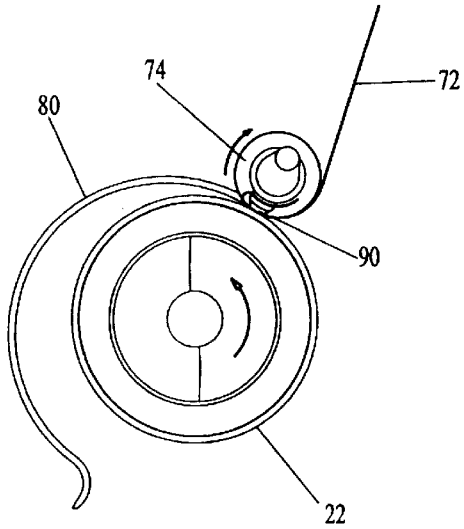
Figure 19:
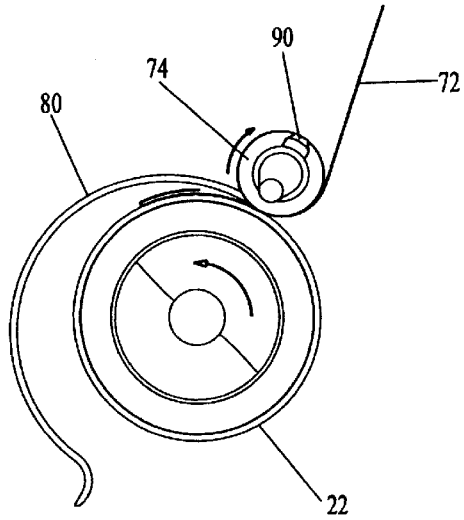

FIG. 18 shows the member 74 rotated approximately 180 degrees from rest position with the lead end of the reserve roll toweling in position on toweling support roller 22. Continued rotation of toweling support roller 22 by the manually actuated one-way clutch mechanism will pull the lead end from clips 90 and the toweling will be transported by toweling support roller 22 in the manner described above. The tension springs 86 bring the member 74 to its initial, rest position, the toweling 72 having insufficient frictional force to prevent such return.

Figure 20:
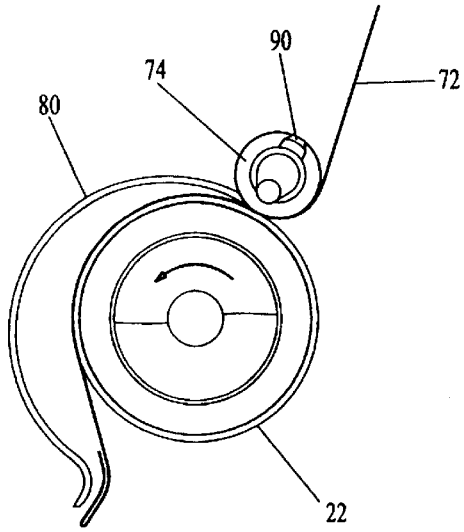
Figure 21:
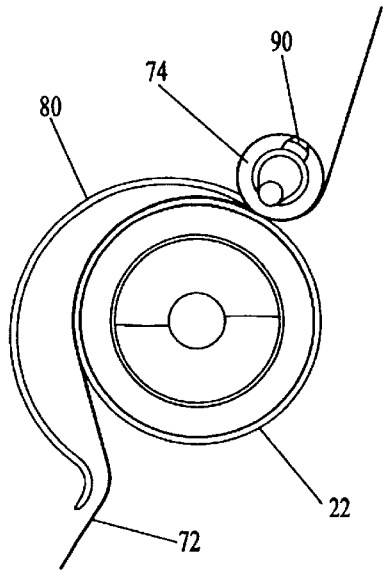
Figure 22:
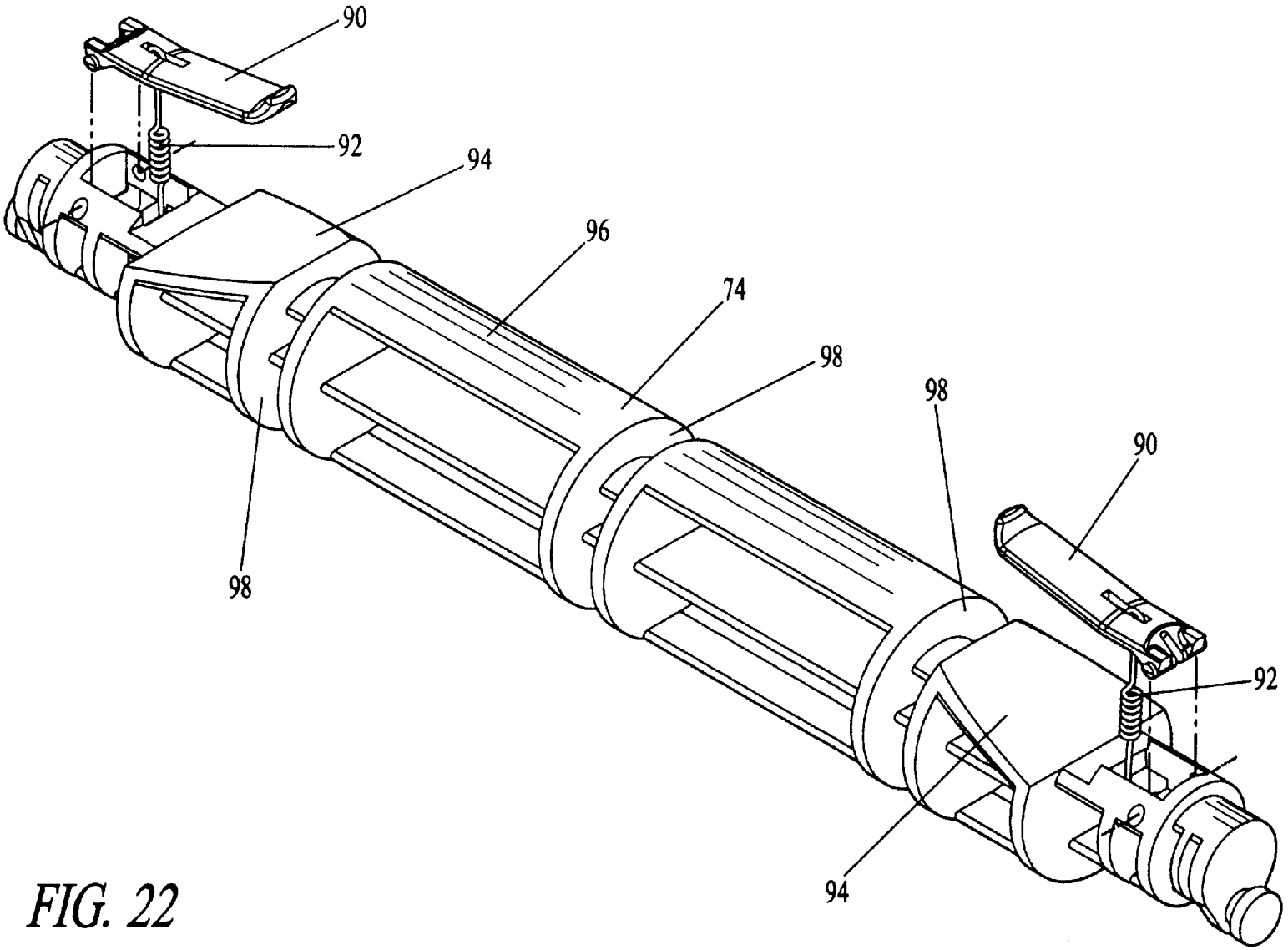
FIG. 22 is an enlarged perspective view of a component of the apparatus.

FIG. 20 shows the lead end of the toweling from the reserve roll exiting the gap between the guide plate 80 and the toweling support roller 22. FIG. 21 shows the lead end of the toweling presented for grasping by the user.

What is claimed is:

1. A method of dispensing paper toweling from a roll of paper toweling, said method comprising the steps of:

positioning paper toweling extending from the roll of paper toweling and having an underside and a lead end on an outer peripheral portion of a rotatable toweling support roller;

pulling the lead end of the paper toweling to tension the paper toweling and cause rotation of the toweling support roller in a direction of rotation;

while said paper toweling is under tension and responsive to rotation of the toweling support roller, pivoting a blade pivotally connected to the toweling support roller about a pivot at the outer peripheral portion thereof from a non-cutting position wherein the blade lies substantially flat against the toweling support roller externally of the toweling support roller with a cutting edge thereof closely adjacent to the outer peripheral portion to bring the cutting edge of the blade into engagement with the underside of the paper toweling on said toweling support roller and bring the blade to a cutting position wherein said blade is disposed at an acute angle relative to the outer peripheral portion with the cutting edge spaced from the toweling support roller and the blade projecting outwardly from said pivot in a direction generally opposed to the direction of rotation of said toweling support roller; and maintaining the paper toweling under tension by continuing to apply a pulling force thereto pulling the paper toweling directly against the cutting edge generally in the direction of rotation of said toweling support roller while said blade is in said cutting position and the cutting edge thereof engages the paper toweling to sever the paper toweling.

2. The method according to claim 1 including the step of biasing the toweling support roller against rotation while the blade moves to the cutting position from the non-cutting position.

* * * * *